US006310433B1

(12) United States Patent
Youn et al.

(10) Patent No.: US 6,310,433 B1
(45) Date of Patent: Oct. 30, 2001

(54) INNER SHIELD FOR A CATHODE RAY TUBE AND METHOD FOR MANUFACTURING THE SAME

(75) Inventors: Hae-Su Youn; Hwan-Cheol No, both of Kyongsangnam-do (KR)

(73) Assignee: Samsung Display Devices Co., Ltd., Suwon (KR)

( * ) Notice: Subject to any disclaimer, the term of this patent is extended or adjusted under 35 U.S.C. 154(b) by 0 days.

(21) Appl. No.: 09/260,969

(22) Filed: Mar. 2, 1999

(30) Foreign Application Priority Data

Mar. 17, 1998 (KR) ..... 98-9020

(51) Int. Cl.[7] ..... H01J 29/80
(52) U.S. Cl. ..... 313/402; 313/407; 445/8
(58) Field of Search ..... 313/402, 407, 313/479; 315/8, 85; 445/1, 8, 37, 47

(56) References Cited

U.S. PATENT DOCUMENTS 3,822,453 * 7/1974 Shrader ..... 313/313

FOREIGN PATENT DOCUMENTS

406243794A * 9/1994 (JP) .

* cited by examiner

*Primary Examiner*—Michael H. Day
*Assistant Examiner*—Joseph Williams
(74) *Attorney, Agent, or Firm*—Robert E. Bushnell, Esq.

(57) ABSTRACT

An inner shield for a cathode ray tube comprising a plurality of rectangular segments parallel to the tube axis; a flange joined to each of the rectangular segments and bent in a right angle for mounting on a mask frame; a trapezoid portion joined to each of the rectangular segments, being arranged slantwise along an inner circumference of a funnel; and a pair of holes formed in the two adjacent trapezoid portions to decrease a deflection in a East-West direction of an electron beams. Since an undesirable affection on the electron beams caused by the earth magnetic field is decreased, a pin-cushion distortion and barrel distortion of the electron beams are highly decreased.

2 Claims, 3 Drawing Sheets

INNER SHIELD FOR A CATHODE RAY TUBE AND METHOD FOR MANUFACTURING THE SAME

BACKGROUND OF THE INVENTION

1. Field of the invention

This invention relates to an inner shield for a cathode ray tube, more particularly to an inner shield arranged with the minimized distances from an inner surface of a funnel and enable to effectively shield an earth magnetic field with vertical and horizontal magnetic field to improve degaussing efficiency.

2. Description of the prior art

Generally, electron beams emitted from an electron gun of a cathode ray tube (CRT) are affected by an earth magnetic field, so that paths of the electron beams are curved to cause the change of raster position and to deteriorate the purity and convergence characteristics of the CRT.

Accordingly, an inner shield is provided in the CRT to shield the earth magnetic field. The inner shield is arranged to the rear side of a mask frame that is suspended on a stud pin by a supporting spring, so that the inner shield extends along an inner surface of the funnel toward the electron gun.

Such a conventional inner shield is shown in FIG. 3. A V-typed notch is formed at an edge of an vertical inclined portion of the inner shield of which a front end has a rectangular shape to decrease the deflection of the electron beams caused by influence of the earth magnetic field.

In general, when the CRT is positioned in the North-South direction, the electron beams are affected with the earth magnetic field generated in the direction clockwise according to the Fleming's left-hand rule. The earth magnetic field tends to be incident to the material with high permeability at a right angle. The inner shield having a V-typed notch causes the earth magnetic field transferred from the electron gun to a screen to be deflected toward the horizontal inclined portion of the inner shield. Then the electron beams are affected in a direction counterclockwise by a vertical earth magnetic field induced from the V-typed notch.

However, when the CRT is positioned in the East-West direction, the CRT is increasingly affected by the earth magnetic field. That is, the earth magnetic field affect parallel to the horizontal portion of the inner shield, passing the V-typed notch thereof. Therefore shielding effect against the earth magnetic field is decreased, which causes the landing characteristics to be deteriorated.

SUMMARY OF THE INVENTION

Therefore, the present invention has been made in an effort to solve the above described drawbacks of the prior art.

It is an object of the present invention to provide an inner shield wherein an earth magnetic field effect can be decreased so that high picture quality may be obtained in a cathode ray tube(CRT).

To achieve the above object, the present invention provides the inner shield used in the cathode ray tube comprising:

- a plurality of rectangular segments parallel to the tube axis
- a flange joined to each of the rectangular segments and bent in a right angle for mounting on a mask frame;
- a trapezoid portion joined to each of the rectangular segments, being arranged slantwise along an inner circumference of a funnel; and

- a pair of holes formed in the two adjacent trapezoid portions to decrease a deflection in a East-West direction of electron beams.

It is another object of the present invention to provide a method for manufacturing the inner shield comprising the steps of:

- cutting a metal sheet to form eight rectangular segments, each of which includes a flange at one low end for mounting on a mask frame;
- cutting a notch to form a trapezoid portion at an opposite end portion of the rectangular segments;
- forming a pair of holes in the two adjacent trapezoid portions
- bending the trapezoid portion slantwise along an inner circumference of a funnel and the flange in a right angle; and
- joining opposite free side ends of a pair of cut metal sheet to form an octagonal shaped inner shield.

BRIEF DESCRIPTION OF THE DRAWING

The present invention will become more fully understood from the detailed description given hereinafter and the accompanying drawings which are given by way of illustration only, and thus are not limited of the present invention and wherein.

DETAILED DESCRIPTION OF THE INVENTION

Figure 1:
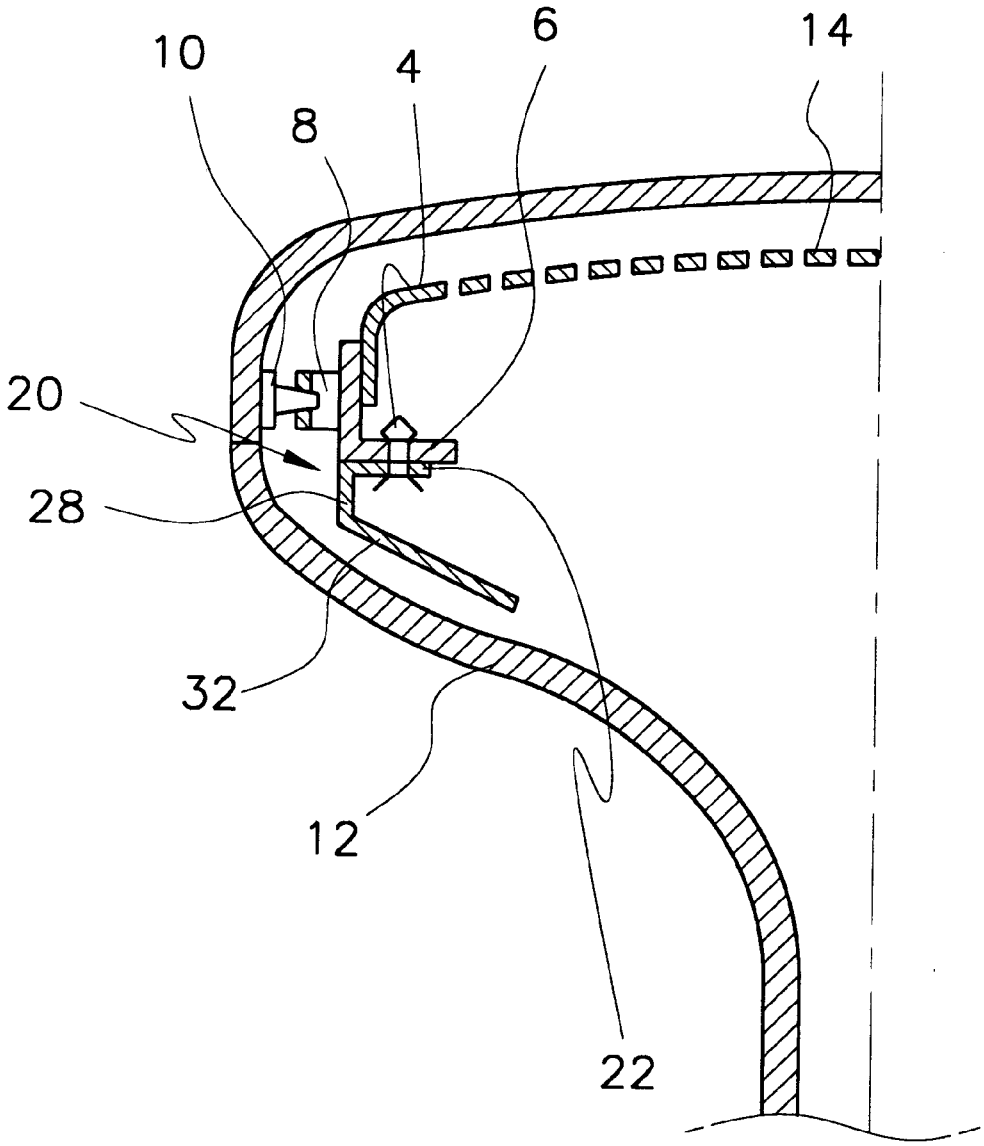
FIG. 1 is a partial sectional view of a CRT having an inner shield therein

The following is the description of the preferred embodiments according to the present invention. In the drawings, like reference numerals have been used to identify like elements in each figure.

Referring to FIG. 1, there is illustrated an inner shield 20 for a cathode ray tube provided on a rear side of a mask frame 6 including a shadow mask 14 at a front side thereof. Flanges 22 formed at a front end of the inner shield 20 are fixed to the mask frame 6 with clips 4.

The inner shield 20 is mounted on the mask frame 6 which is suspended on a stud pin 10 by a support spring 8 such that the inner shield 20 is arranged to extend along an inner circumference of a funnel 12.

According to the present invention, the inner shield 20 comprises eight rectangular segments 28 which are parallel to the tube axis and joined to form an octagonal shaped inner shield 20. Each of the rectangular segments 28 has a flange 22 bent in a right angle for mounting on the mask frame 6, and a trapezoid portion 32 arranged slantwise along the inner circumference of the funnel 12. In addition, a pair of holes 27 are formed in the two adjacent slanted parts of the trapezoid portions 32 to decrease the deflection of electron beams in the East-West directions.

The inner shield 20 according to the present invention is manufactured by the following method.

Figure 2:
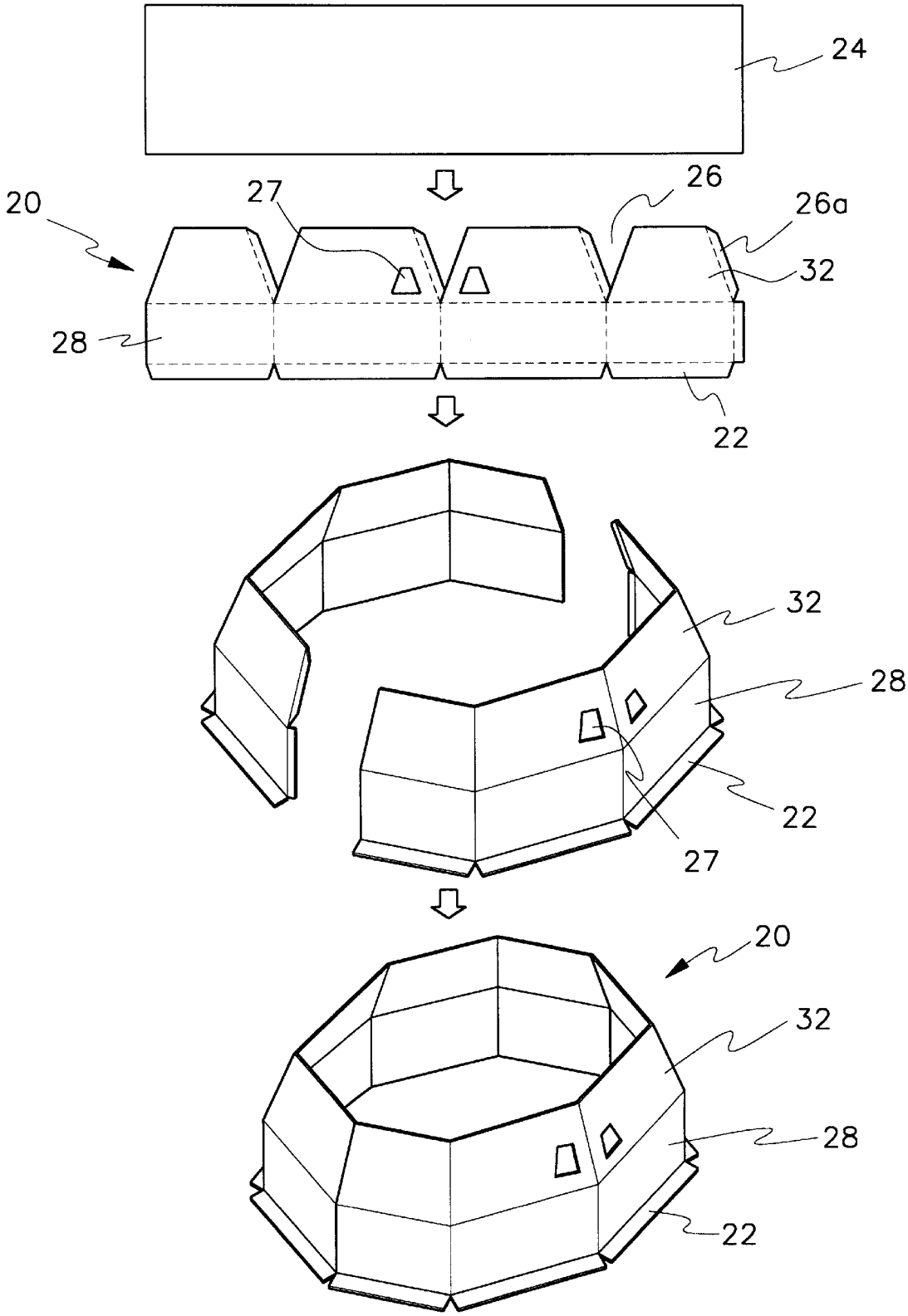
FIG. 2 shows the steps of manufacturing an inner shield according to the present invention.
Figure 3:
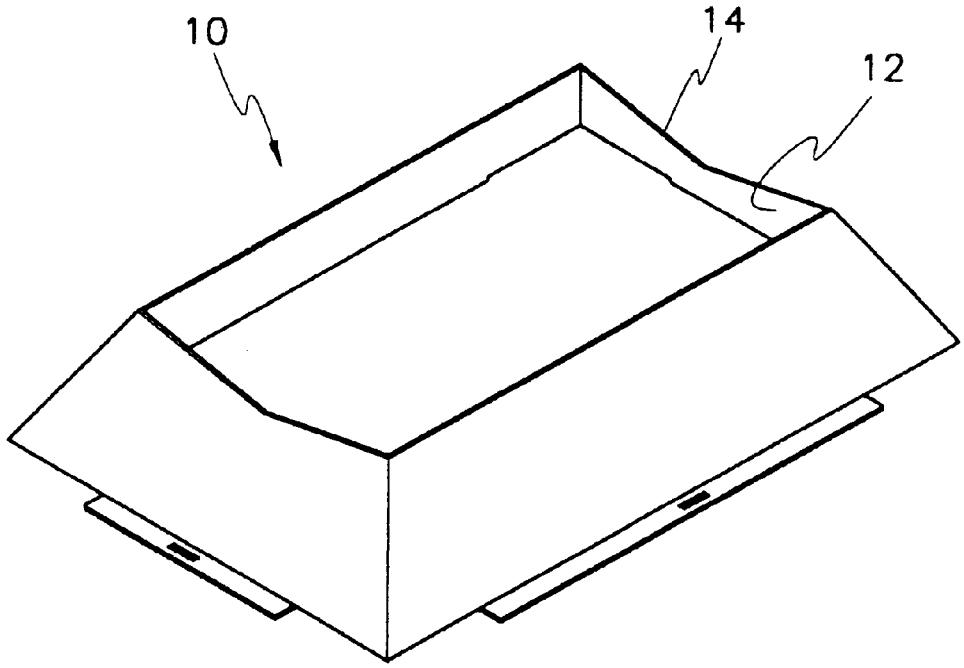
Fig. 3 (PRIOR ART)
FIG. 3 is a perspective view of a prior inner shield.

As illustrated in the FIG. 2, at first a pair of planer metal sheets 24 are cut to form eight rectangular segments 28 with folding lines. Each of the rectangular segments 28 includes a flange 22 at one low end to be bent for mounting on a mask frame 6. Notches 26 are formed at the upper end portion of the rectangular segments 28, and the upper end portion becomes a trapezoid shape. A pair of holes 27 are formed at two adjacent trapezoid portions 32, respectively.

The trapezoid portion 32 is then bent slantwise along the inner circumference of the funnel 12 and the flange 22 in the right angle to the rectangular segments 28. And the opposite free side ends of a pair of cut metal sheets 24 are welded each other to form an octagonal shaped inner shield 20.

The inner shield 20 may be arranged with a corresponding curvature to the adjacent inner circumference of the funnel 12 since it is formed in the octagonal shape.

Therefore, the earth magnetic field incident on the slanted trapezoid portion 32 are discharged through the adjacent slanted parts. Accordingly an undesirable affection on the electron beams caused by the earth magnetic field is decreased, a pin-cushion distortion and barrel distortion of the electron beams are highly decreased.

While this invention has been described in connection with what is presently considered to be the most practical and preferred embodiments, it is to be understood that the invention is not limited to the disclosed embodiment, but, on the contrary, is intended to cover various modifications and equivalent arrangements and methods included within the spirit and scope of the appended claims.

What is claimed is:

1. An inner shield for a cathode ray tube, comprising:

a plurality of rectangular segments parallel to the tube axis;

a flange joined to each of the rectangular segments and bent in a right angle for mounting on a mask frame;

a trapezoid portion joined to each of the rectangular segments, being arranged slantwise along an inner circumference of a funnel; and a pair of holes formed at two adjacent trapezoid portions.

2. A method of manufacturing an inner shield for a cathode ray tube having a funnel including a mask frame, said method comprising the steps of:

cutting a pair of metal sheets to form eight rectangular segments, each of which is parallel to a tube axis and includes a flange at one low end for mounting on the mask frame;

cutting a notch to form a trapezoid portion at an opposite end portion of the rectangular segments;

forming a pair of holes at two adjacent trapezoid portions;

bending the trapezoid portion slantwise along an inner circumference of the funnel and each flange in a right angle with respect to a respective rectangular segment; and joining an opposite free side ends of a pair of cut metal sheets to form an octagonal shaped inner shield.

* * * * *